US012317980B1

(12) United States Patent
Ren

(10) Patent No.: US 12,317,980 B1
(45) Date of Patent: Jun. 3, 2025

(54) AUTOMATIC VACUUM SUITCASE

(71) Applicant: Xu Ren, Guangdong (CN)

(72) Inventor: Xu Ren, Guangdong (CN)

( * ) Notice: Subject to any disclaimer, the term of this patent is extended or adjusted under 35 U.S.C. 154(b) by 0 days.

(21) Appl. No.: 18/829,471

(22) Filed: Sep. 10, 2024

(51) Int. Cl.
*A45C 13/02* (2006.01)
*A45C 5/03* (2006.01)

(52) U.S. Cl.
CPC ..... *A45C 13/02* (2013.01); *A45C 5/03* (2013.01); *A45C 2013/028* (2013.01)

(58) Field of Classification Search
CPC ..... A45C 13/02; A45C 5/03; A45C 2013/028
See application file for complete search history.

(56) References Cited

U.S. PATENT DOCUMENTS 2,258,541 A * 10/1941 Cressaty ..... A45C 15/06 D28/83
6,202,849 B1 * 3/2001 Graham ..... B65D 25/16 206/524.8
6,520,071 B1 * 2/2003 Lanza ..... B65B 31/047 141/96
7,086,211 B2 * 8/2006 Bassett ..... B65B 41/04 53/512
2015/0089903 A1 * 4/2015 Carey ..... A45C 13/02 53/434

FOREIGN PATENT DOCUMENTS

CN 106332270 A * 1/2017

* cited by examiner

*Primary Examiner* — Tri M Mai
(74) *Attorney, Agent, or Firm* — Justin Lampel

(57) ABSTRACT

An automatic vacuum suitcase includes a suitcase body and a vacuumizing assembly. A vacuum bag is connected inside a case body of the suitcase body in a sealing manner, the vacuumizing assembly includes a panel, a housing, a motor, a battery, and a vacuum pump, the housing is secured to an inner wall of the case body, the battery and the motor are mounted inside the housing, the vacuum pump is secured on the housing, a suction port of the vacuum pump is connected to the vacuum bag, the vacuum pump is driven by the motor, the motor is powered by the battery, the panel is secured to an outer wall of the case body, a power button is disposed on the panel, the panel is provided with an operation port connected to a mounting cavity of the battery, and the operation port is sealed with a detachable cap.

4 Claims, 6 Drawing Sheets

AUTOMATIC VACUUM SUITCASE

TECHNICAL FIELD

The present disclosure belongs to the technical field of daily necessities, and in particular to an automatic vacuum suitcase.

BACKGROUND

Suitcases, also known as traveling cases and draw-bar boxes, are used to carry articles such as clothing, personal care products required on the journey. At present, there are a large number of hard-shell suitcases on the market. The hard-shell suitcases are durable and suitable for luggage required to be protected. When fabrics or compressible articles with fillers are put in the hard-shell suitcases, because of fluffiness of the articles, large space is occupied, and it is difficult to utilize the space inside the suitcases.

SUMMARY

In view of the defects in the prior art, the present disclosure provides an automatic vacuum suitcase. A vacuum bag is disposed in the automatic vacuum suitcase, and can be vacuumized. Therefore, fabric or compressible articles with fillers that are put in the vacuum bag can be compressed by vacuumizing, to greatly improve a space utilization rate, so that more articles can be carried when a same-sized suitcase is used.

An automatic vacuum suitcase in the present disclosure includes a suitcase body and a vacuumizing assembly, where a vacuum bag is connected inside a case body of the suitcase body in a sealing manner, the vacuumizing assembly includes a panel, a housing, a motor, a battery, and a vacuum pump, the housing is secured to an inner wall of the case body, the battery and the motor are mounted inside the housing, the vacuum pump is secured on the housing, a suction port of the vacuum pump is connected to the vacuum bag, the vacuum pump is driven by the motor, the motor is powered by the battery, the panel is secured to an outer wall of the case body, a power button is disposed on the panel, the panel is provided with an operation port connected to a mounting cavity of the battery, and the operation port is sealed with a detachable cap. An air outlet of the vacuum pump is exposed outside the vacuum bag. The motor drives the vacuum pump to extract air outside the vacuum bag. The panel on an outer side and the housing on an inner side are connected to each other via screws, and clamped and secured on a side wall of the suitcase body, and the main control board is secured between the inner side of the panel and the housing. Three two-color indicator lights are further disposed on the panel. The motor, the power button, and the three two-color indicator lights are all connected to the main control board. A chip (model: NY8A062F SOP14, and manufacturer: Nyquest Technology Co., Ltd.) is mounted on the main control board. The case body of the suitcase body means an upper case body or/and a lower case body of the suitcase body. In other words, the vacuum bag and the vacuumizing assembly may be disposed in the upper case body of the suitcase body, may be disposed in the lower case body of the suitcase body, or may be separately disposed in the upper case body and the lower case body of the suitcase body, to implement purposes of the present disclosure.

Working states and displaying states of the vacuumizing assembly are as follows:

I. Long press on the power button: It means that power is on/off.

II. Short press on the power button: It means that the motor starts to work. In a working process, the motor is suspended by short pressing the power button once, and reworks by pressing the power button again. The motor automatically stops working after continuously working 60 seconds.

III. Three two-color indicator lights (a blue indicator light and a red indicator light): After power is on, the blue indicator light goes on (power correlation display of three blue indicator lights indicates that three blue indicator lights all going on means 100% power, two blue indicator lights going on means 60% power, and one blue indicator light going on means 30% power). When a battery level is lower than 20%, the three blue indicator lights are in red and flash. This means to charge. When a battery level is lower than 10%, the motor shuts down automatically. After work each time, a red light goes on (a quantity of lighted beads are synchronized with the battery level).

IV. The motor shuts down automatically if not being used within ten minutes.

Further, the vacuum bag is secured to the inner wall of the case body by gluing, and an opening is provided on the vacuum bag and sealed with an airtight zipper, a top corner, corresponding to the case body, of the vacuum bag is concaved inwardly, and space used for mounting the housing, the motor, the battery, and the vacuum pump is formed between the vacuum bag and the case body. Articles can be conveniently fetched from the vacuum bag, the suction port of the vacuum pump extends into the vacuum bag via a connection hole on the vacuum bag, a ring-shaped connection plate is secured on the vacuum pump, and an edge, at the connection hole, of the vacuum bag is secured and sealed with the ring-shaped connection plate. Due to the ring-shaped connection plate, the vacuum pump is effectively connected to the vacuum bag, and the periphery of the connection hole on the vacuum bag is specifically supported, to prevent the vacuum bag from blocking the suction port and the air outlet of the vacuum pump.

Further, the battery is a detachable lithium battery, the operation port is provided with an external threaded interface that protrudes externally, and the detachable cap is provided with an internal thread and screwed to the operation port. The motor is a 3.7V motor, and directly welded to the main control board. The lithium battery is a 16,340 mAh to 650 mAh rechargeable 3.7V lithium battery, and may be detached for charging. The main control board is designed without charging, so that the automatic vacuum suitcase can be easy to carry on an airplane for travel. Therefore, service lift of the automatic vacuum suitcase is prolonged.

Further, a first contact pin that is used to conductively connect an electrode of the battery is secured in the detachable cap, a second contact pin that is used to conductively connect another electrode of the battery is secured in a battery compartment of the housing, and the first contact pin extends to the internal thread of the detachable cap; a conductive sheet conductively connected to the first contact pin in the detachable cap is disposed at an external thread of the operation port, and the conductive sheet and the second contact pin are both connected to a main control board located on an inner side of the panel. The first contact pin and the conductive sheet are naturally engaged by tightening the detachable cap, or naturally disconnected by tightening the detachable cap.

Further, an anti-blocking cover is secured at the suction port of the vacuum pump, and a top center and a side of the anti-blocking cover are provided with an air vent, to prevent the suction port of the vacuum pump from being blocked with articles in the vacuum bag.

The present disclosure has the following beneficial effect. According to the automatic vacuum suitcase of the present disclosure, the vacuum bag is disposed in the automatic vacuum suitcase, to automatic vacuumizing the vacuum bag. Therefore, fabric or compressible articles with fillers that are put in the vacuum bag can be compressed by vacuumizing, to greatly improve a space utilization rate, so that more articles can be carried when a same-sized suitcase is used.

BRIEF DESCRIPTION OF THE DRAWINGS

In order to illustrate the specific implementations of the present disclosure or the technical solutions in the prior art more clearly, accompanying drawings needing to be used in the description of the specific implementations or the prior art will be briefly described below. In the accompanying drawings, similar elements or portions are generally identified by similar reference numerals. In the accompanying drawings, each element or portion is not necessarily drawn to an actual scale.

DETAILED DESCRIPTION OF THE EMBODIMENTS

The embodiments of the technical solutions of the present disclosure will be described in detail below with reference to the accompanying drawings. The following embodiments are only used to more clearly illustrate the technical solutions of the present disclosure. Therefore, these embodiments are merely exemplary and are not intended to limit the protection scope of the present disclosure.

It should be noted that the technical terms or scientific terms used herein should have the ordinary meanings as understood by those skilled in the art to which the present disclosure belongs, unless otherwise stated.

Figure 1:
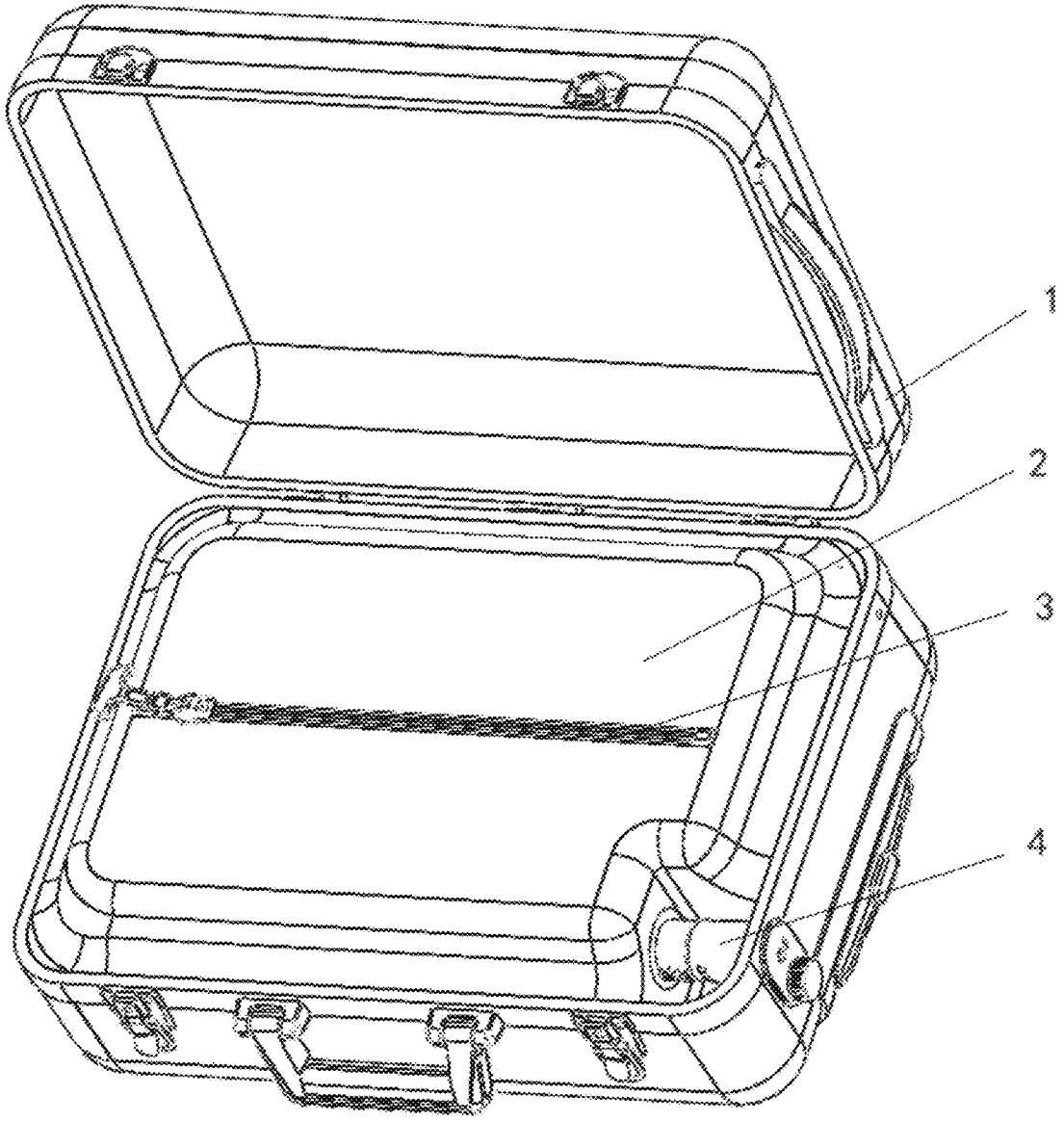
FIG. 1 is a schematic diagram of a structure of the present disclosure.
Figure 2:
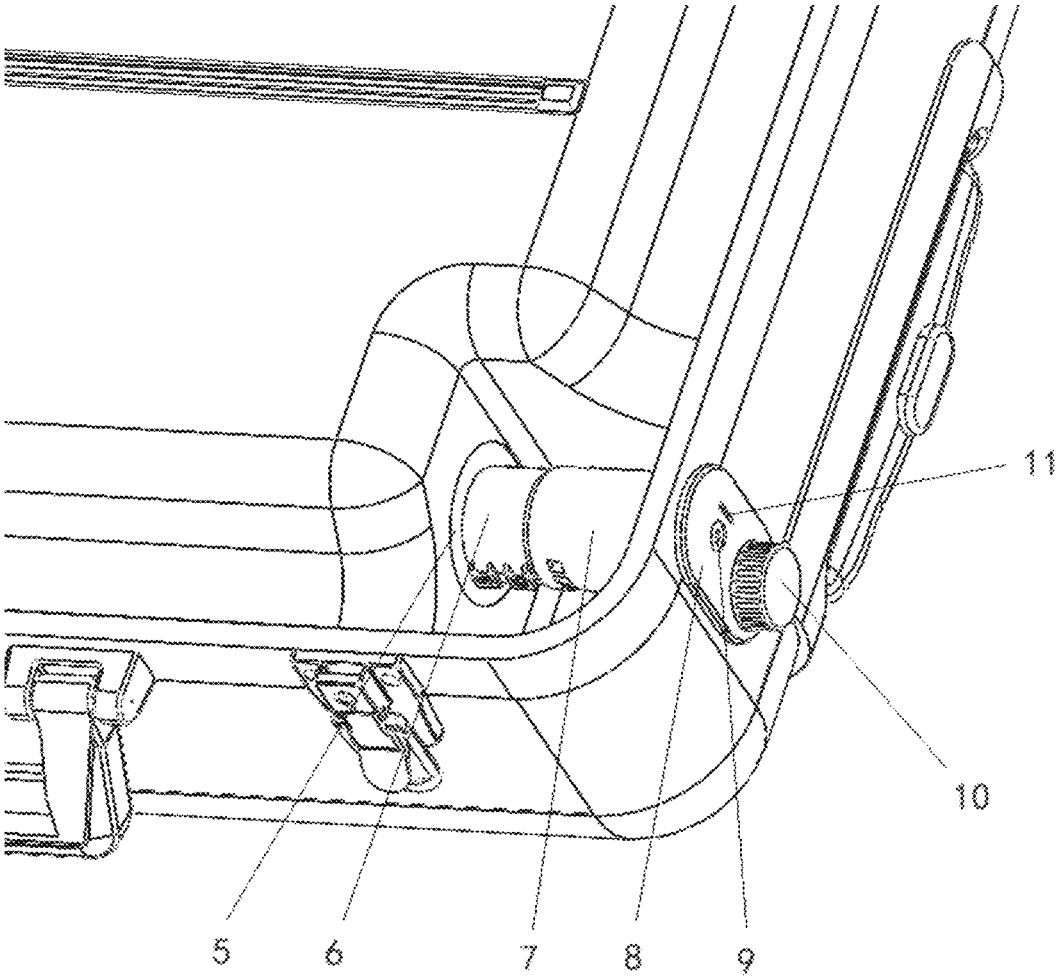
FIG. 2 is a partial view of FIG. 1.
Figure 3:
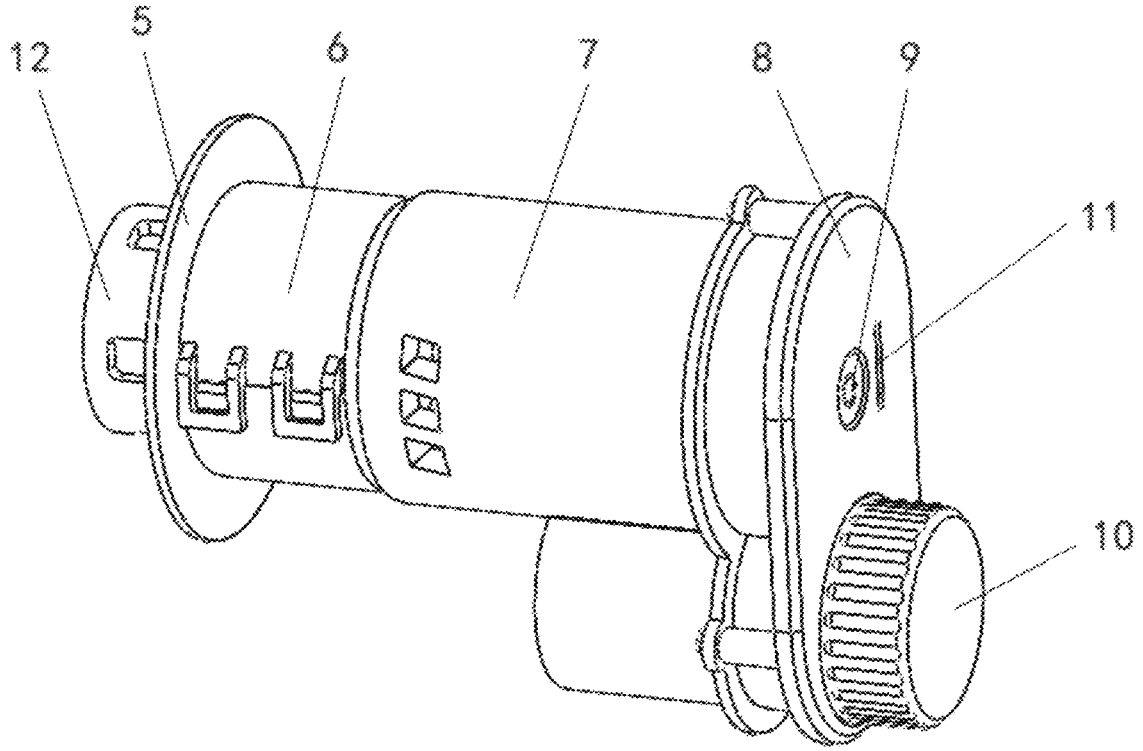
FIG. 3 is a schematic diagram of a structure of a vacuumizing assembly.
Figure 4:
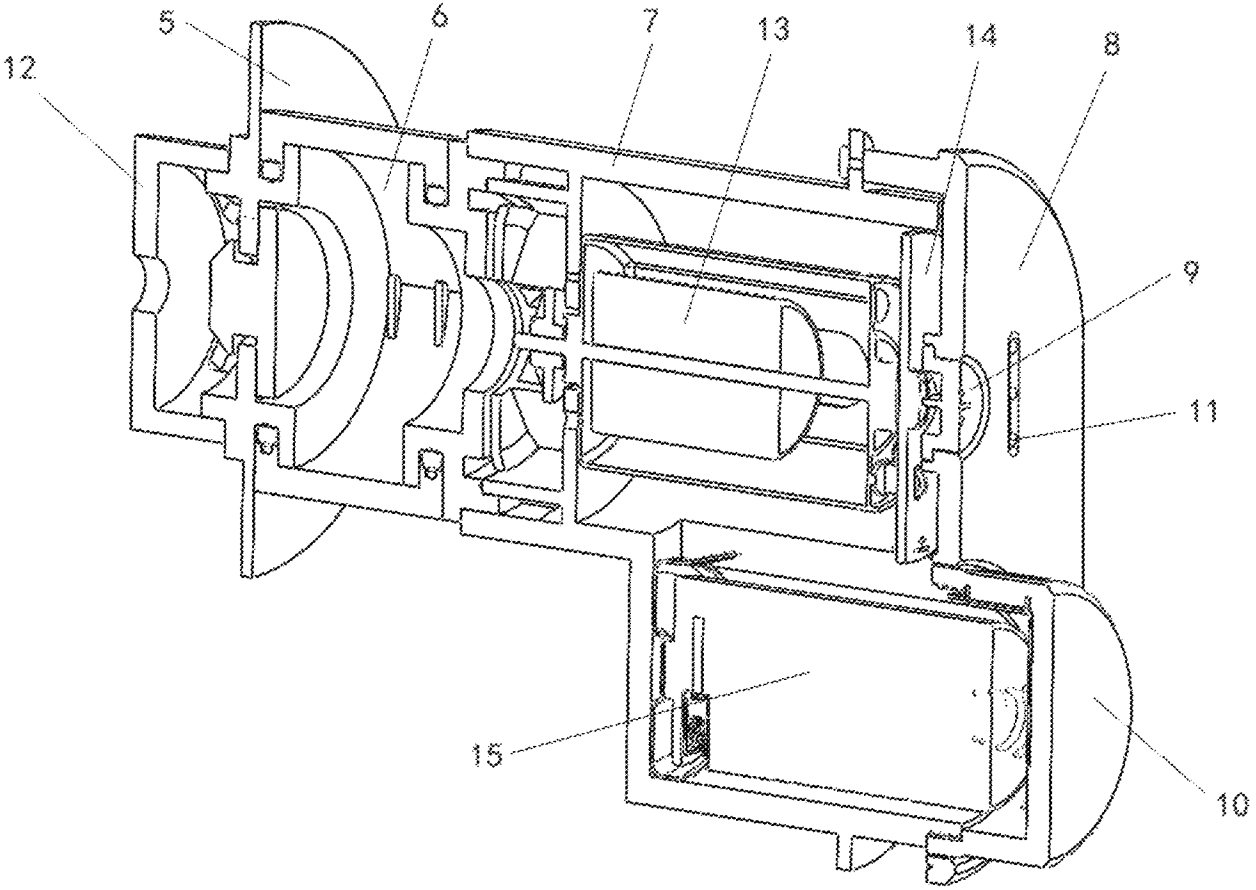
FIG. 4 is a sectional view of a vacuumizing assembly.
Figure 5:
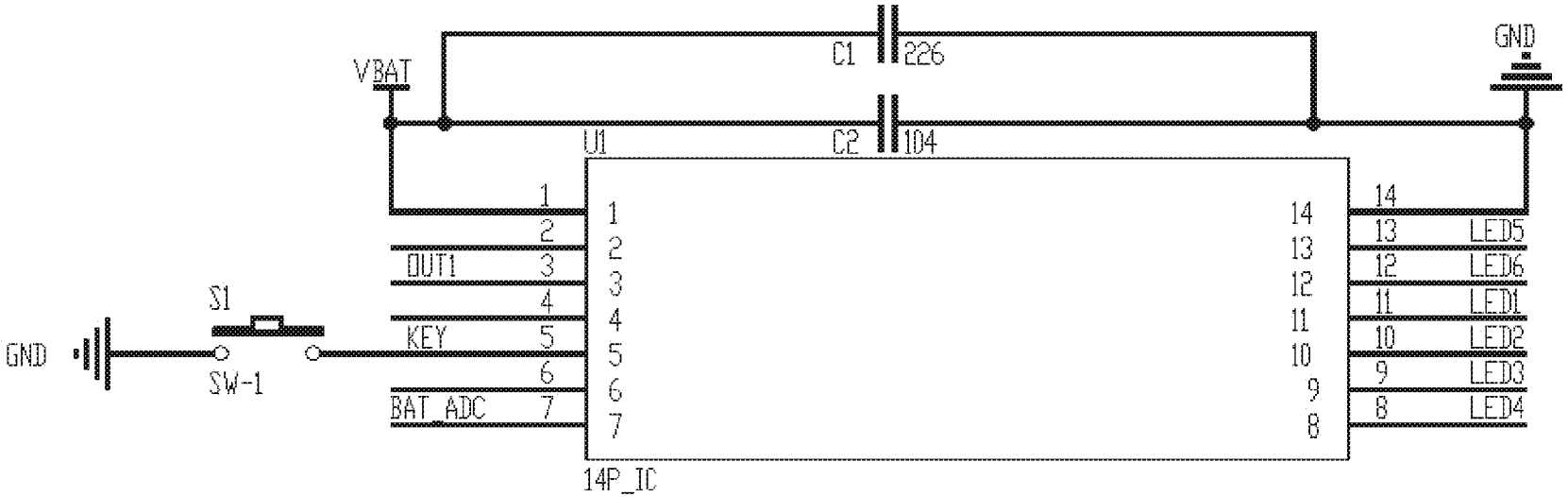
FIG. 5 is a schematic diagram of a control circuit of a power button.
Figure 6:
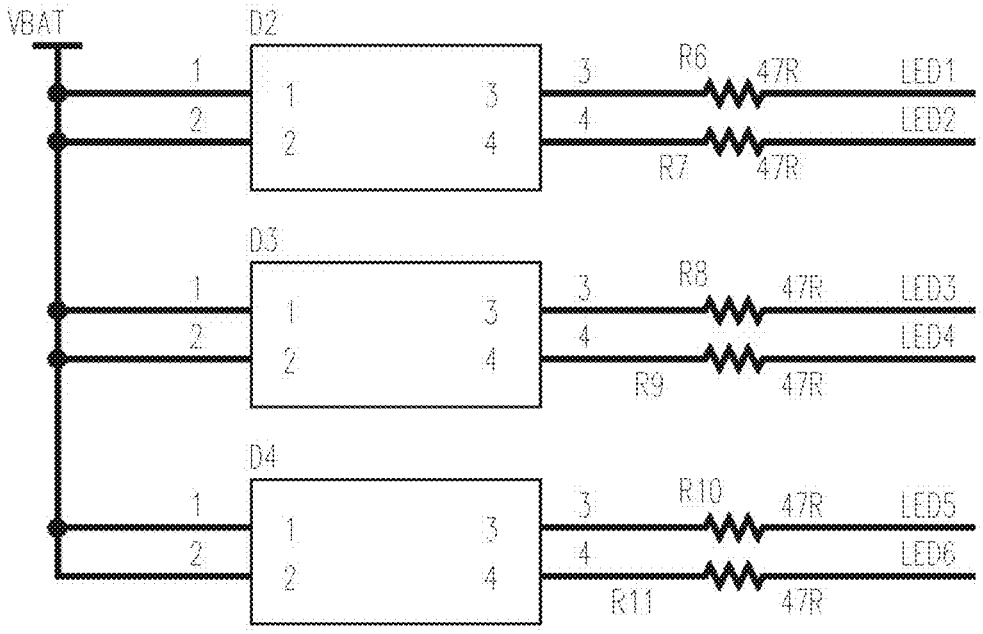
FIG. 6 is a schematic diagram of a control circuit of three two-color indicator lights.

Referring to FIG. 1 to FIG. 6, an automatic vacuum suitcase in the embodiments includes a suitcase body 1 and a vacuumizing assembly 4. A vacuum bag 2 is connected inside a case body of the suitcase body 1 in a sealing manner. The vacuumizing assembly 4 includes a panel 8, a housing 7, a motor 13, a battery 15, and a vacuum pump 6. The housing 7 is secured to an inner wall of the case body, the battery 15 and the motor 13 are mounted inside the housing 7, the vacuum pump 6 is secured on the housing 7, a suction port of the vacuum pump 6 is connected to the vacuum bag 2, the vacuum pump 6 is driven by the motor 13, the motor 13 is powered by the battery 15, the panel 8 is secured to an outer wall of the case body, a power button 9 is disposed on the panel 8, the panel is provided with an operation port connected to a mounting cavity of the battery 15, and the operation port is sealed with a detachable cap 10. An air outlet of the vacuum pump 6 is exposed outside the vacuum bag 2. The motor 13 drives the vacuum pump 6 to extract air outside the vacuum bag 2. The panel 8 on an outer side and the housing 7 on an inner side are connected to each other via screws, and clamped and secured on a side wall of the suitcase body 1, and a main control board 14 is secured between the inner side of the panel 8 and the housing 7. Three two-color indicator lights 11 are further disposed on the panel 8. The motor 13, the power button 9, and the three two-color indicator lights 11 are all connected to the main control board 14. A chip (model: NY8A062F SOP14, and manufacturer: Nyquest Technology Co., Ltd.) is mounted on the main control board 14. The case body of the suitcase body 1 means an upper case body or/and a lower case body of the suitcase body 1. In other words, the vacuum bag 2 and the vacuumizing assembly 4 may be disposed in the upper case body of the suitcase body 1, may be disposed in the lower case body of the suitcase body 1, or may be separately disposed in the upper case body and the lower case body of the suitcase body 1, to implement purposes of the present disclosure. Drawings of the present disclosure show that the vacuum bag 2 and the vacuumizing assembly 4 are disposed in the lower case body of the suitcase body 1.

Working states and displaying states of the vacuumizing assembly 4 are as follows:

I. Long press on the power button 9: It means that power is on/off.

II. Short press on the power button 9: It means that the motor 13 starts to work. In a working process, the motor 13 is suspended by short pressing the power button once, and reworks by pressing the power button again. The motor 13 automatically stops working after continuously working 60 seconds.

III. Three two-color indicator lights 11 (a blue indicator light and a red indicator light): After power is on, the blue indicator light goes on (power correlation display of three blue indicator lights indicates that three blue indicator lights all going on means 100% power, two blue indicator lights going on means 60% power, and one blue indicator light going on means 30% power). When a battery level is lower than 20%, the three blue indicator lights are in red and flash. This means to charge. When a battery level is lower than 10%, the motor shuts down automatically. After work each time, a red light goes on (a quantity of lighted beads are synchronized with the battery level).

IV. The motor shuts down automatically if not being used within ten minutes.

In this embodiment, the vacuum bag 2 is secured to the inner wall of the case body by gluing, and an opening is provided on the vacuum bag 2 and sealed with an airtight zipper 3. A top corner, corresponding to the case body, of the vacuum bag 2 is concaved inwardly, and space used for mounting the housing 7, the motor 13, the battery 15, and the vacuum pump 6 is formed between the vacuum bag 2 and the case body. Articles can be conveniently fetched from the vacuum bag 2, the suction port of the vacuum pump 6 extends into the vacuum bag 2 via a connection hole on the vacuum bag 2, a ring-shaped connection plate 5 is secured on the vacuum pump 6, and an edge, at the connection hole, of the vacuum bag 2 is secured and sealed with the ring-shaped connection plate 5. Due to the ring-shaped connection plate 5, the vacuum pump 6 is effectively connected to the vacuum bag 2, and the periphery of the connection hole on the vacuum bag 2 is specifically supported, to prevent the vacuum bag 2 from blocking the suction port and the air outlet of the vacuum pump 6.

In this embodiment, the battery 15 is a detachable lithium battery 15, the operation port is provided with an external threaded interface that protrudes externally, and the detachable cap 10 is provided with an internal thread and screwed to the operation port. The motor 13 is a 3.7V motor, and directly welded to the main control board 14. The lithium battery 15 is a 16,340 mAh to 650 mAh rechargeable 3.7V lithium battery, and may be detached for charging. The main control board 14 is designed without charging, so that the automatic vacuum suitcase can be easy to carry on an airplane for travel. Therefore, service lift of the automatic vacuum suitcase is prolonged.

In this embodiment, a first contact pin that is used to conductively connect an electrode of the battery 15 is secured in the detachable cap 10, a second contact pin that is used to conductively connect another electrode of the battery 15 is secured in a battery compartment of the housing 7, and the first contact pin extends to the internal thread of the detachable cap 10. A conductive sheet conductively connected to the first contact pin in the detachable cap 10 is disposed at an external thread of the operation port, and the conductive sheet and the second contact pin are both connected to the main control board 14 located on an inner side of the panel 8. The first contact pin and the conductive sheet are naturally engaged by tightening the detachable cap 10, or naturally disconnected by tightening the detachable cap 10.

In this embodiment, an anti-blocking cover 12 is secured at the suction port of the vacuum pump 6, and a top center and a side of the anti-blocking cover 12 are provided with an air vent, to prevent the suction port of the vacuum pump 6 from being blocked with articles in the vacuum bag 2.

Finally, it should be noted that the above embodiments are provided merely for describing the technical solutions of the present disclosure, but not for limiting the present disclosure. Although the present disclosure is described in detail with reference to the above embodiments, a person of ordinary skill in the art should understand that they may still make modifications to the technical solutions described in the above embodiments or make equivalent replacements to some or all technical features thereof; and these modifications or replacements do not make the essence of the corresponding technical solution depart from the scope of the technical solutions of the embodiments of the present disclosure, and shall fall within the scope of claims and specification of the present disclosure.

What is claimed is:

1. An automatic vacuum suitcase, comprising a suitcase body and a vacuumizing assembly, wherein a vacuum bag is connected inside a case body of the suitcase body in a sealing manner, the vacuumizing assembly comprises a panel, a housing, a motor, a battery, and a vacuum pump, the housing is secured to an inner wall of the case body, the battery and the motor are mounted inside the housing, the vacuum pump is secured on the housing, a suction port of the vacuum pump is connected to the vacuum bag, the vacuum pump is driven by the motor, the motor is powered by the battery, the panel is secured to an outer wall of the case body, a power button is disposed on the panel, the panel is provided with an operation port connected to a mounting cavity of the battery, and the operation port is sealed with a detachable cap;

wherein the vacuum bag is secured to the inner wall of the case body by gluing, and an opening is provided on the vacuum bag and sealed with an airtight zipper; and a top corner, corresponding to the case body, of the vacuum bag is concaved inwardly, and space used for mounting the housing, the motor, the battery, and the vacuum pump is formed between the vacuum bag and the case body; and wherein the battery is a detachable lithium battery, the operation port is provided with an external threaded interface that protrudes externally, and the detachable cap is provided with an internal thread and screwed to the operation port.

2. The automatic vacuum suitcase according to claim 1, wherein a first contact pin that is used to conductively connect an electrode of the battery is secured in the detachable cap, a second contact pin that is used to conductively connect another electrode of the battery is secured in a battery compartment of the housing, and the first contact pin extends to the internal thread of the detachable cap; and a conductive sheet conductively connected to the first contact pin in the detachable cap is disposed at an external thread of the operation port, and the conductive sheet and the second contact pin are both connected to a main control board located on an inner side of the panel.

3. The automatic vacuum suitcase according to claim 1, wherein an anti-blocking cover is secured at the suction port of the vacuum pump, and a top center and a side of the anti-blocking cover each are provided with an air vent.

4. The automatic vacuum suitcase according to claim 2, wherein an anti-blocking cover is secured at the suction port of the vacuum pump, and a top center and a side of the anti-blocking cover each are provided with an air vent.

* * * * *